US005638914A

United States Patent [19]

Kizzia

[11] Patent Number: 5,638,914

[45] Date of Patent: Jun. 17, 1997

[54] PORTABLE PLATFORM SYSTEM

[76] Inventor: Mark A. Kizzia, 409 Irving, Fort Gibson, Okla. 74434

[21] Appl. No.: 445,669

[22] Filed: May 22, 1995

[51] Int. Cl.[6] ..... E04G 3/12; E04G 1/36; E04G 1/16

[52] U.S. Cl. ..... 182/45; 182/117; 182/222

[58] Field of Search ..... 182/45, 117, 119, 182/222

[56] References Cited

U.S. PATENT DOCUMENTS

| | | | |
|---|---|---|---|
| 2,446,093 | 7/1948 | Lambert | 182/45 |
| 2,903,226 | 9/1959 | D'Haveloose . | |
| 3,355,136 | 11/1967 | Staples . | |
| 3,765,509 | 10/1973 | Taylor | 182/119 |
| 5,148,890 | 9/1992 | Sipe . | |
| 5,201,488 | 4/1993 | Hadbavny . | |
| 5,351,926 | 10/1994 | Moses . | |

FOREIGN PATENT DOCUMENTS

| | | | |
|---|---|---|---|
| 1275506 | 9/1960 | France | 182/45 |
| 0029691 | 10/1910 | Sweden | 182/45 |
| 0651175 | 3/1951 | United Kingdom | 182/45 |
| 2131475 | 6/1984 | United Kingdom | 182/45 |
| 2192660 | 1/1988 | United Kingdom | 182/45 |
| 0014840 | 10/1991 | WIPO | 182/45 |

OTHER PUBLICATIONS

S.W. Nunnally, "Construction Methods and Management," Sec. 12–3, 3rd Edition, Regents/Prentice Hall, p. 291.

*Primary Examiner*—Daniel P. Stodola
*Assistant Examiner*—Matthew A. Kaness
*Attorney, Agent, or Firm*—Head, Johnson & Kachigian

[57] ABSTRACT

A portable telescoping platform system. The platform system includes a plurality of telescoping poles, each pole having a removable lower bracket and a removable upper bracket. A plurality of legs extend from each telescoping pole, each leg extending in angular relation to the telescoping pole. A plurality of braces are provided with each brace extending between pairs of adjacent upper brackets. A platform is supported by and on the braces.

17 Claims, 3 Drawing Sheets

12
14
16
18
20
22
24
30
31
32
33
34
36
38
40
42
44
46
48
50
52
53
56
58
60
62
63
70
72
74
78

PORTABLE PLATFORM SYSTEM

BACKGROUND OF THE INVENTION

1. Field of the Invention.

The present invention is directed to a telescoping platform system which is portable and movable to and from a desired job site and is adjustable in length to a desired height. In particular, the present invention is directed to a portable telescoping platform system which is adaptable for use in building construction.

2. Prior Art

Frame building construction will typically utilize studs, joists and rafters to form the building frame. These framing members are usually of nominal 2-inch (approximately 5 cm) thickness.

In construction of a building with a peaked roof, the roof is installed after the ceiling joists of the building frame have been completed. A roof ridge for a peaked roof is spaced from, parallel to and vertical to the ceiling joists. The height of the roof ridge will vary depending on the design but is often 8' to 12' from the ceiling joists.

One existing procedure to install the roof is to build a temporary wooden frame from lumber at the construction site to form a platform for construction workers. The platform is attached at its base to the ceiling joists and is temporary in nature. The standard building ceiling joists range from nominal two inches by six inches to two inches by twelve inches. The temporary platform that is built will terminate below the level of the roof ridge, in one instance approximately five feet from the roof ridge. A construction worker or workers then may ascend to stand on the wooden platform that has been built. The construction worker or workers will thereafter be able to raise the roof ridge to the desired level and attach rafters, hips and valleys.

It is known to take several hours in time to build and then remove the temporary wooden scaffolding which is presently used at the work site. The wooden materials that are cut and used to fabricate the temporary scaffolding are thereafter typically discarded after use as they are often broken and nail ridden.

Accordingly, there exists a need for a portable telescoping platform system that is easily assembled and disassembled and is transportable.

There is also a need for a portable telescoping platform system that is reusable.

There is also a need for a portable telescoping platform system that is attachable to ceiling joists of a building frame for installation of a roof ridge.

There also exists a need for a platform system that is readily adjustable in height or length.

SUMMARY OF THE INVENTION

The present invention provides a portable telescoping platform system which includes a plurality of telescoping poles. The telescoping pole includes a removable lower bracket which fits over a ceiling joist. The lower bracket may optionally be temporarily fastened or secured to the ceiling joist during use.

A plurality of legs extend from the telescoping pole. A first end of each leg may be attached to other ceiling joists. Each leg is provided with an opening through which a fastener will engage the ceiling joist. Each leg extends in angular relation to the telescoping pole. Each leg is hingedly connected to a cylindrical sleeve which is received over the telescoping pole. The telescoping pole includes a radially extending collar to prevent downward movement of the sleeves past a certain point.

The telescoping pole also includes a removable upper bracket which, when assembled and installed, will receive a brace. The brace will extend between pairs of adjacent telescoping poles and their adjacent upper brackets. The brace, in turn, will support a platform for workers.

Each pole includes a lower pole member and an upper pole member. The upper and lower pole members are cylindrical and in axial alignment with each other. The upper pole member has a slightly smaller exterior diameter than the inner diameter of the lower pole member.

The lower pole member includes a pair of channel steps perpendicular to the axis of the lower pole member. The upper pole member may optionally include steps in the form of removable rungs. The optional rungs will be inserted through openings in the upper pole member. Threaded ends of the rungs will be secured by nuts.

Once the platform system has been installed, a construction worker or workers will ascend to the platform utilizing the steps of the lower pole member and the step rungs of the upper pole member.

DETAILED DESCRIPTION OF THE PREFERRED EMBODIMENTS

Figures 1, 3, 4:
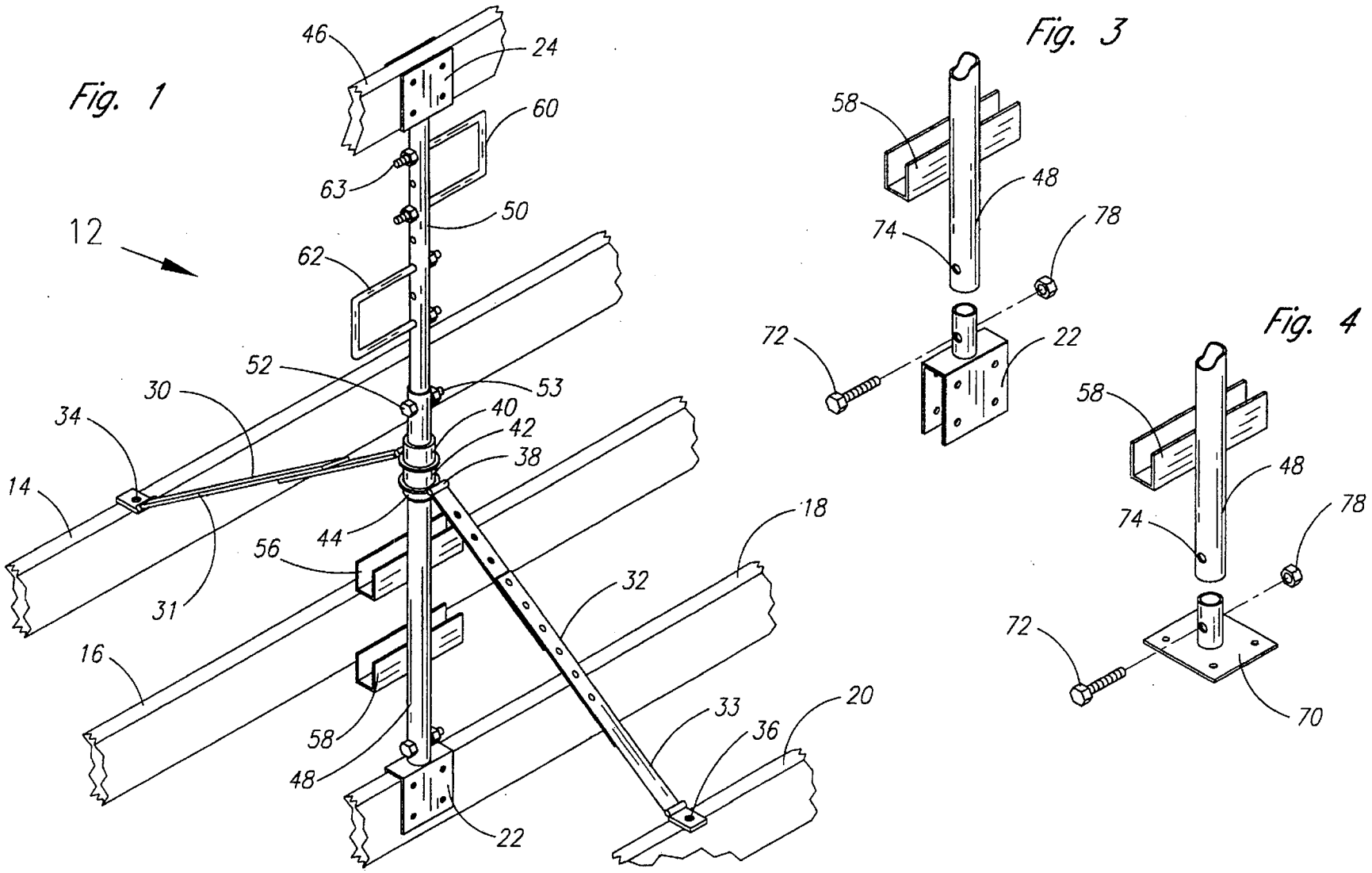
FIG. 1 illustrates a perspective view of a telescoping pole used as a part of the telescoping platform system of the present invention.
FIG. 3 is a partial view of the lower pole member of the telescoping pole shown in FIG. 1.
FIG. 4 is an alternate embodiment of the lower pole member shown in FIG. 3.

Referring to the drawings in detail, FIG. 1 shows a single telescoping pole 12 which is a part of a portable telescoping platform system 10 to be described herein. The telescoping platform system of the present invention has a number of applications. As shown in FIG. 1, one pertinent application is to be used by construction workers in installing a roof ridge for a peaked roof. In building construction, the roof is normally installed after the ceiling joists 14, 16, 18 and 20 (shown in partial cutaway) which are parallel to each other. The ceiling joists are of standard dimensions, such as 2"×6" up to 2"×12" nominal size.

The telescoping pole 12 includes a lower bracket 22. The lower bracket 22 fits over one of the ceiling joists 18. In the present embodiment, the lower bracket is C-shaped or channel-shaped and is slightly wider than the 2" nominal size to fit over the ceiling joist.

As will be described herein, the lower bracket 22 may optionally be temporarily fastened or secured to the ceiling joist 18. The telescoping pole 12 also includes an upper bracket 24 at the opposite end thereof. The upper bracket 24 is likewise C-shaped or channel-shaped and is 1⅝" or slightly wider.

The telescoping pole 12 also includes a plurality of cylindrical legs 30 and 32 which extend from the telescoping pole 12. A first end 31 and 33 of each leg 30 and 32 may be attached to other ceiling joists such as ceiling joist 14 and ceiling joist 20. Each leg includes a telescoping mechanism to adjust the length of the leg and thereby meet the desired ceiling joist. Accordingly, leg 30 is provided with an opening 34 and leg 32 is provided with an opening 36 through which a fastener will engage a ceiling joist.

When installed as seen in FIG. 1, each leg 30 and 32 extends in angular relation to the telescoping pole. The opposite end of each leg 30 and 32 terminates in a hinge 38 and 39, respectively (hinge 38 of leg 32 visible in FIG. 1). Each hinge connects with a short cylindrical sleeve 40 and 42, each of which is received over and on the telescoping pole 12. The interior diameter of the cylindrical sleeve is slightly larger than the exterior diameter of the pole. The telescoping pole 12 includes a collar 44 to prevent downward movement of the cylindrical sleeves past a certain point.

Once the pole has been assembled and installed, the upper bracket 24 will receive a brace 46 of substantial strength for the job (shown cutaway in FIG. 1). The brace 46 will extend between pairs of adjacent telescoping poles and pairs of adjacent upper brackets 24 (not shown) in FIG. 1. The brace 46, in turn, will support a platform (not shown) for workers.

In the present embodiment, each pole 12 includes a lower pole member 48 and an upper pole member 50. In the present embodiment, the upper and lower pole members 48 and 50 are cylindrical and in axial alignment with each other. The upper pole member 48 has a slightly smaller exterior diameter than the inner diameter of the lower pole member 50. Accordingly, the pole members 48 and 50 slidingly telescope in order to establish the desired length or height of the pole 12. A fastener, such as a bolt 52 and nut 53, will be inserted in an opening 54 through the lower pole member 48 and opening in the upper pole member 50 to secure the lower pole member to the upper pole member. In an optional embodiment, a spring-loaded pin may be used to quickly secure the lower pole member to the upper pole member.

Figure 2:
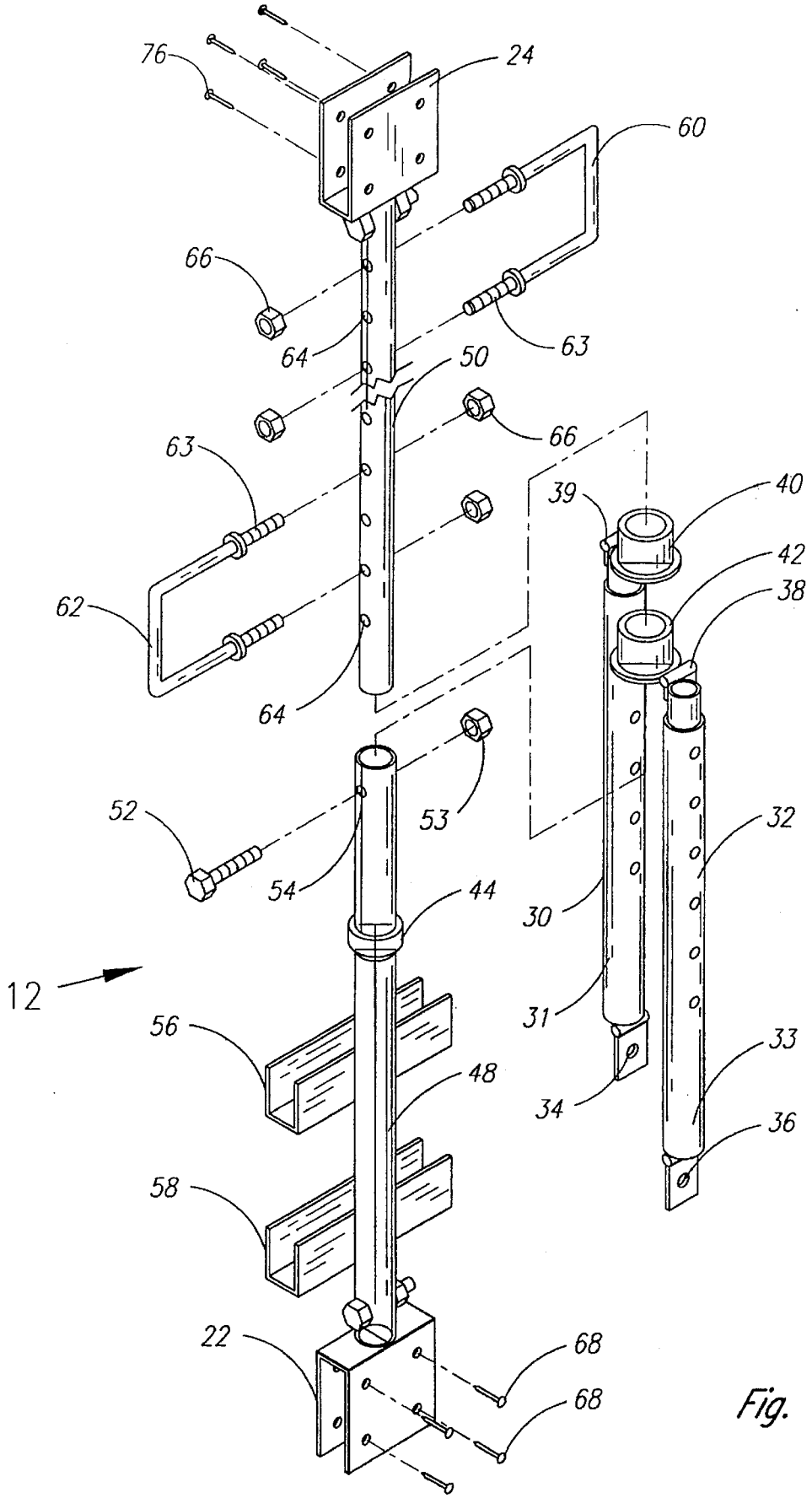
FIG. 2 is an exploded view of the telescoping pole shown in FIG. 1.

FIG. 2 is an exploded view of the various components of one of the telescoping platform poles 12 of the present system. Since the components are readily assembled for use and disassembled for storage and transportation, the system lends itself to be portable in that it may be carried to and from a work site. The system 10 may be installed at the work site and then be reused at the next work site.

The lower pole member 48 includes a pair of channel steps 56 and 58 perpendicular to the axis of the pole. A construction worker may climb the channel steps 56 and 58 themselves. Alternatively, a brace piece (not shown) may extend between adjacent channel steps to form a ladder for climbing. The upper pole member 50 may include optional steps in the form of rungs 60 and 62. Each rung includes a pair of threaded ends 63 which pass through openings 64 in the upper pole member 50 so that the ends may be secured by nuts 66.

In a further alternative, a brace piece (not shown) may extend between adjacent channel steps to form a brace for a lower level platform (not shown).

The legs 30 and 32 are shown detached and apart from the telescoping pole in FIG. 2. Cylindrical sleeves 40 and 42 will slide and fit over the exterior of the lower member 48 with cylindrical sleeve 40 resting on collar 44 while cylindrical sleeve 40 rests on sleeve 42. Once the cylindrical sleeves are placed over the top of the lower member, the upper pole member may be fastened by fastener 52. The cylindrical sleeves are not rigidly fastened to the pole so that radial movement of the legs is permitted.

The lower bracket 22 may be fastened to the ceiling joist 18 by nails 68 or other fasteners.

As best seen in the partial, exploded views in FIGS. 3 and 4, the lower bracket 22 may be removable from the lower pole member 48. FIG. 3 shows the lower member 48 exploded from the lower bracket 22. The lower bracket may be interchanged for other brackets or other support mechanisms such as pad 70 shown in FIG. 4. The lower bracket 22 or the pad 70 will be interchangeably secured to the lower pole member 48 by a threaded bolt 72 passing through an opening 74 in the lower pole member and a nut 78. Other mechanisms to fasten the lower bracket 22 to the lower pole such as a spring-loaded pin are, of course, possible.

The upper bracket 24 would likewise be removable from the upper pole member 50.

Figure 5:
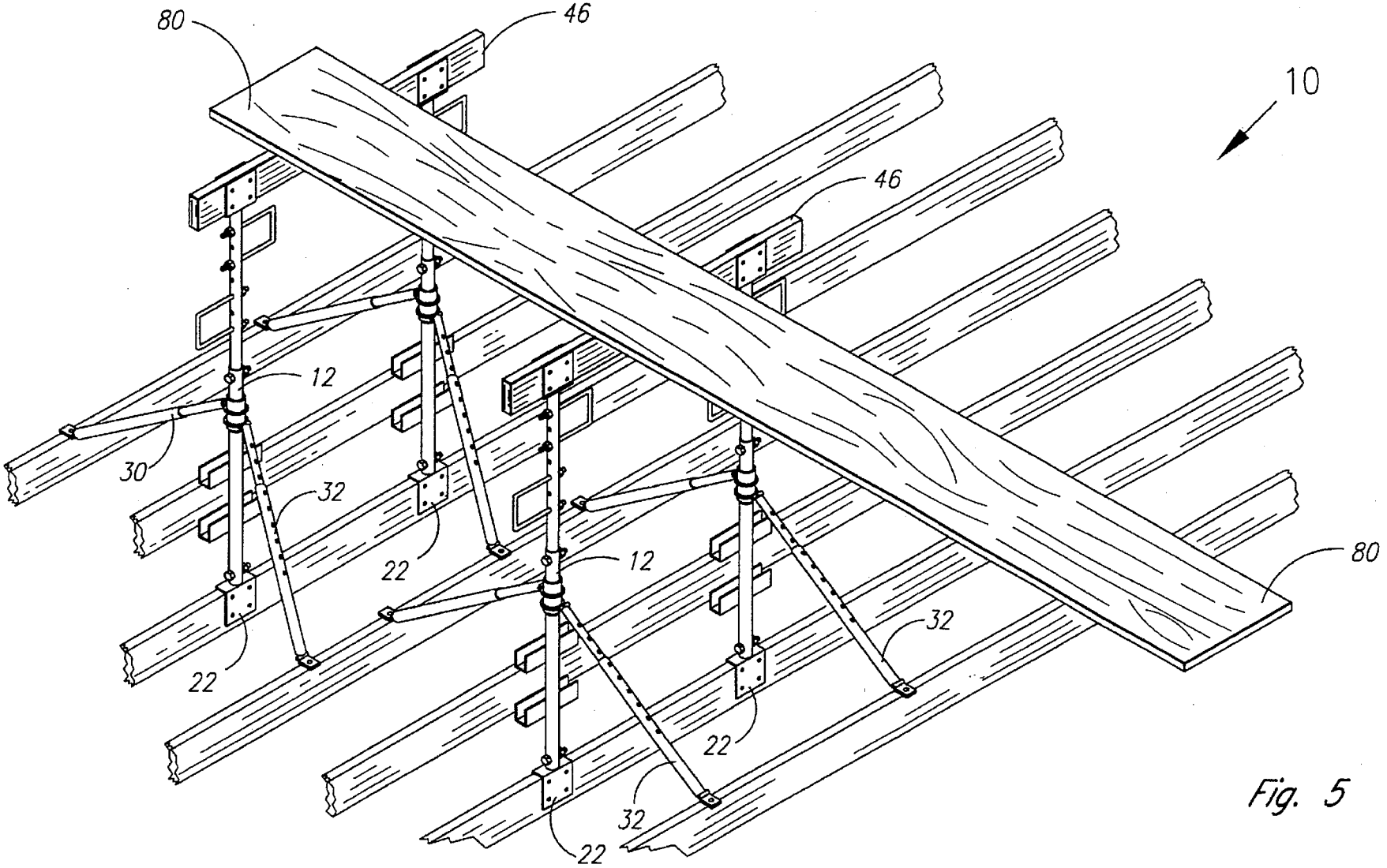
FIG. 5 is a perspective view of the portable telescoping platform system of the present invention.

FIG. 5 illustrates a perspective view of a platform system 10 installed for use in construction of a building.

To utilize the platform system 10, the elements will be brought to the construction work site. The appropriate lower bracket 22 or pad 70 will be connected with the lower pole member 48 with fasteners 72 and 78. The legs 30 and 32 will be unfolded at hinges if the legs are engaged with the lower member 48. If the legs have been removed, the cylindrical sleeve 42 of leg 32 will be slipped over the lower member. The cylindrical sleeve 40 of leg 30 will then be slipped over the lower pole member. The upper pole member 50 will next be inserted into the open end of the lower pole member and adjusted so that the telescoping pole 12 will be at the proper height. Bolt 52 will be threaded through opening 54 in the lower pole member and through an opening in the upper pole member to fix the telescoping pole at a desired height.

The legs will be radially and angularly adjusted. Fasteners will be placed through the opening 34 in leg 30 and through the opening 36 in leg 32 and the fasteners secured to other ceiling joists.

The optional rungs 60 and 62 will be inserted through openings 64 in the upper pole member. The threaded ends of the rungs will be secured by nuts 66. Once the desired number of telescoping poles has been installed, a brace 46 will be placed between adjoining upper brackets 24. The brace 46 may be secured to the upper brackets through fasteners such as nails 76. At least two parallel braces will be established between at least two pairs of poles 12. Thereafter, a platform 80 or platforms will be placed on and supported by the braces. Once the platform system 10 has been installed, a construction worker or workers will ascend to the platform utilizing steps 56 and 58 and step rungs 60 and 62. The construction workers may then easily raise the roof ridge or the like.

To take down the scaffolding, the reverse procedure will be performed. The platform and braces will be removed and each telescoping pole 12 will be removed from the ceiling joists.

Whereas, the present invention has been described in relation to the drawings attached hereto, it should be understood that other and further modifications, apart from those shown or suggested herein, may be made within the spirit and scope of this invention.

What is claimed is:

1. A portable telescoping platform system for at least one ceiling joist, which comprises:

a plurality of telescoping poles, each pole having a lower bracket and an upper bracket, wherein each said lower bracket fits over and receives said ceiling joist;

each said telescoping pole including an upper pole member and a lower pole member;

a plurality of legs extending from each said telescoping pole, each said leg having a first end hingedly connected to said telescoping pole to adjust spacing of a second end from said pole with said leg extending in angular relation to said telescoping pole wherein each said leg is adjustable in length;

a plurality of braces, each brace extending between pairs of adjacent upper brackets; and a platform supported by said braces.

2. A portable telescoping platform system as set forth in claim 1 including means to fasten each said lower bracket to said ceiling joist.

3. A portable telescoping platform system as set forth in claim 1 wherein each said telescoping pole includes means to lock said upper and lower members together at a position for a desired pole length.

4. A portable telescoping platform system as set forth in claim 3 wherein said lower pole member includes at least one step.

5. A portable telescoping platform system as set forth in claim 3 wherein said upper pole member includes at least one removable rung.

6. A portable telescoping platform system as set forth in claim 1 wherein said legs are radially adjustable with respect to said telescoping pole.

7. A portable telescoping platform system as set forth in claim 1 wherein each said leg engages said pole by a cylindrical sleeve.

8. A portable telescoping platform system as set forth in claim 1 wherein said legs are radially adjustable with respect to said telescoping pole.

9. A portable telescoping platform system as set forth in claim 1 wherein each said lower bracket is detachable.

10. A portable telescoping platform system for at least one ceiling joist, which comprises:

a plurality of telescoping poles, each pole having a removable lower bracket and an upper bracket, wherein each said lower bracket fits over and receives said ceiling joist;

each said telescoping pole including an upper pole member and a lower pole member;

a plurality of legs extending from each said telescoping pole, each said leg having a first end hingedly connected to said telescoping pole to adjust spacing of a second end from said pole with said leg extending in angular relation to said telescoping pole wherein each said leg is adjustable in length;

a plurality of braces, each said brace extending between pairs of adjacent upper brackets; and a platform supported by said braces.

11. A portable telescoping platform system as set forth in claim 10 including means to fasten each said lower bracket to said ceiling joist.

12. A portable telescoping platform system as set forth in claim 10 wherein each said telescoping pole includes means to lock said upper and lower members together at a position for a desired pole length.

13. A portable telescoping platform system as set forth in claim 12 wherein said lower pole member includes at least one step.

14. A portable telescoping platform system as set forth in claim 12 wherein said upper pole member includes at least one removable rung.

15. A portable telescoping platform system as set forth in claim 10 wherein each said lower bracket is detachable.

16. A telescoping pole for a platform system for at least one ceiling joist, which pole comprises:

a lower pole member having a first end terminating in a removable lower bracket, wherein said lower bracket will fit over and receive said ceiling joist;

an upper pole member having a first end terminating in an upper bracket;

means to adjust the length of said pole by a removable connection between a second end of said lower pole member and a second end of said upper pole member; and a plurality of legs detachably connected to said pole, each said leg having a first end hingedly connected to said telescoping pole so adjust spacing of a second end from said pole with said leg extending in angular relation to said pole wherein each said leg is adjustable in length.

17. A telescoping pole as set forth in claim 16 wherein said lower bracket fits over a ceiling joist and including means to fasten each said lower bracket to said ceiling joist.

* * * * *

UNITED STATES PATENT AND TRADEMARK OFFICE

CERTIFICATE OF CORRECTION

PATENT NO. : 5,638,914

DATED : June 17, 1997

INVENTOR(S) : Mark A. KIZZIA

It is certified that error appears in the above-identified patent and that said Letters Patent is hereby corrected as shown below:

Column 3, line 11, after "hinge", insert --38 and 39--;

Column 4, line 22, after "hinges", insert --38 and 39--; and

Column 6, line 36 (claim 16, line 14), delete "so" and substitute --to-- therefor.

Signed and Sealed this

Second Day of December, 1997

*Attest:*

*Attesting Officer*

Bruce Lehman

BRUCE LEHMAN

*Commissioner of Patents and Trademarks*